US012287144B2

(12) United States Patent
Heyrman et al.

(10) Patent No.: US 12,287,144 B2
(45) Date of Patent: Apr. 29, 2025

(54) HYDROGEN LIQUEFACTION SYSTEM AND METHOD

(71) Applicant: Chart Energy & Chemicals, Inc., Ball Ground, GA (US)

(72) Inventors: Brent A. Heyrman, The Woodlands, TX (US); Timothy P. Gushanas, Pearland, TX (US); Ravikumar Vipperla, Katy, TX (US); Mathew R. Watt, Conroe, TX (US); Douglas A. Ducote, Jr., The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 296 days.

(21) Appl. No.: 17/835,489

(22) Filed: Jun. 8, 2022

(65) Prior Publication Data

US 2022/0390169 A1 Dec. 8, 2022

Related U.S. Application Data

(60) Provisional application No. 63/208,245, filed on Jun. 8, 2021.

(51) Int. Cl.
*F25J 1/00* (2006.01)
*F25J 1/02* (2006.01)

(52) U.S. Cl.
CPC ..... *F25J 1/001* (2013.01); *F25J 1/0072* (2013.01); *F25J 1/0214* (2013.01); *F25J 1/0215* (2013.01)

(58) Field of Classification Search
CPC ..... F25J 1/001; F25J 1/0214; F25J 1/0215; F25J 1/0072
See application file for complete search history.

(56) References Cited

U.S. PATENT DOCUMENTS 3,347,055 A 10/1967 Blanchard et al.
4,765,813 A 8/1988 Gaumer, Jr. et al.
(Continued)

FOREIGN PATENT DOCUMENTS

EP 3368844 9/2018
GB 1000590 8/1965
WO WO2017/072018 A1 5/2017

OTHER PUBLICATIONS

International Search Report and Written Opinion for International Application PCT/US2022/032695 Dated Oct. 5, 2022.
Aasadnia, "Conceptual design and analysis of a novel process for hydrogen liquefaction assisted by absorption precooling system", Journal of Cleaner Production, vol. 205, pp. 565-588 (2018).
Berstad, "Large-scale hydrogen liquefier utilising mixed-refrigerant pre-cooling", International Journal of Hydrogen Energy, vol. 35, No. 10, pp. 4512-4523 (2010).
(Continued)

*Primary Examiner* — Brian M King
(74) *Attorney, Agent, or Firm* — Cook Alex Ltd.

(57) ABSTRACT

A system and method for liquefying a hydrogen gas feed stream uses a pre-cooling refrigerant for pre-cooling the feed stream, where the pre-cooling refrigerant is compressed, cooled and then separated to provide high pressure mixed refrigerant vapor and liquid streams. The high pressure vapor stream is cooled and directed to a cold vapor separator where cold separator liquid and vapor streams are formed. The cold separator vapor stream is cooled and expanded to provide a pre-cool refrigeration stream in a heat exchanger system. The high pressure pre-cooling refrigerant liquid and cold separator liquid streams are cooled and expanded and directed to the pre-cool refrigeration stream. A high pressure primary refrigerant steam, after compression and cooling, is further cooled in the heat exchanger system and then expanded using warm and cold expanders, with the resulting expanded primary refrigerant streams used to liquefy the pre-cooled hydrogen feed stream via heat exchange in the heat exchanger system.

25 Claims, 11 Drawing Sheets

(56) References Cited

U.S. PATENT DOCUMENTS

| | | | | |
|---|---|---|---|---|
| 5,826,444 | A | 10/1998 | Capron et al. | |
| 6,298,688 | B1 | 10/2001 | Brostow et al. | |
| 7,127,914 | B2 | 10/2006 | Roberts et al. | |
| 7,559,213 | B2 | 7/2009 | Allam et al. | |
| 8,464,551 | B2 | 6/2013 | Roberts et al. | |
| 10,816,262 | B2 | 10/2020 | Watanabe et al. | |
| 2010/0031699 | A1 | 2/2010 | Dam et al. | |
| 2010/0083695 | A1 | 4/2010 | Kundig | |
| 2014/0053598 | A1* | 2/2014 | Ishimaru | F25J 1/001 62/606 |
| 2018/0038638 | A1 | 2/2018 | Guillard et al. | |
| 2018/0320957 | A1 | 11/2018 | Cardella et al. | |
| 2018/0347897 | A1* | 12/2018 | Cardella | F25J 1/0072 |
| 2020/0141637 | A1 | 5/2020 | Turney et al. | |
| 2020/0141640 | A1 | 5/2020 | Turney et al. | |

OTHER PUBLICATIONS

Berstad, Dissecting the exergy balance of a hydrogen liquefier: Analysis of a scaled-up claude hydrogen liquefier with mixed refrigerant pre-cooling, International Journal of Hydrogen Energy, vol. 46, No. 11, pp. 8014-8029 (2020).

Howe, Advanced precooling for optimized hydrogen liquefaction, Advances in Hydrogen Technology (2021).

Matsuda et al., Study of Large Hydrogen Liquefaction Process, www.enaa.or.jp/WE-NET/ronbun/1997/e5/sanso1997.html, (1997), (5 pages).

Yin et al., Process Optimization and Analysis of a Novel Hydrogen Liquefaction Cycle, International Journal of Refrigeration 110 (2020) (pp. 219-230).

* cited by examiner

HYDROGEN LIQUEFACTION SYSTEM AND METHOD

CLAIM OF PRIORITY

This application claims the benefit of U.S. Provisional Application No. 63/208,245, filed Jun. 8, 2021, the contents of which are hereby incorporated by reference.

FIELD OF THE DISCLOSURE

The present disclosure relates generally to systems and methods for liquefying hydrogen gas and, more particularly, systems and methods for liquefying hydrogen that include a main or primary cooling loop using a primary refrigerant and a pre-cool loop using a pre-cooling refrigerant.

BACKGROUND OF THE INVENTION

Hydrogen has grown in importance as an alternative energy source as advances are being made in fuel cell technology. In addition, use of fuel cell technology, such as in fuel cell powered vehicles, is growing.

As in the case of other cryogenic fluids, such as liquid natural gas, hydrogen is transported and stored more efficiently in liquid form.

Hydrogen is liquefied at a very low temperature (approximately −253° C./20.3 K) and, as a result, hydrogen liquefaction systems consume a large amount of energy which increases production costs. In addition, hydrogen or helium, or mixtures of the two, are typically used as a refrigerant to liquefy hydrogen. Such refrigerants are expensive to use from a power usage perspective due to their small molecular sizes and the associated power required for processing.

Increases in efficiency and corresponding reductions in energy usage in the liquefaction of hydrogen are desirable.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for liquefying a hydrogen gas feed stream includes a heat exchanger system having a feed gas inlet configured to receive the hydrogen gas feed stream, a product outlet, a cooling passage in fluid communication with the feed gas inlet and the product outlet, a primary refrigerant feed passage, a primary refrigeration passage, a pre-cooling refrigeration passage, a high pressure vapor cooling passage, a cold separator vapor cooling passage, a cold separator liquid cooling passage and a high pressure liquid cooling passage. A primary refrigerant compression system is configured to direct a conditioned primary refrigerant to the primary refrigerant feed passage. A warm expander is in fluid communication with the primary refrigerant feed passage, said warm expander having a warm expander outlet in fluid communication with the primary refrigerant compression system. A cold expander is in fluid communication with the primary refrigerant feed passage, said cold expander having a cold expander outlet in fluid communication with the primary refrigeration passage. The cooling passage is configured so that hydrogen therein is cooled and liquefied by countercurrent heat exchange with primary refrigerant in the primary refrigeration passage. The primary refrigerant compression system is configured to receive, compress and cool vaporized primary refrigerant from the primary refrigeration passages so that a conditioned primary refrigerant is provided. A pre-cooling mixed refrigerant compression system includes a pre-cooling compressor configured to receive and compress a mixed refrigerant stream and to direct a compressed mixed refrigerant stream to a pre-cooling aftercooler. The pre-cooling aftercooler has an aftercooler outlet in fluid communication with a high pressure separation device having a mixed refrigerant vapor outlet configured to direct mixed refrigerant vapor to the high pressure vapor cooling passage and a mixed refrigerant liquid outlet configured to direct mixed refrigerant liquid to the high pressure liquid cooling passage. A cold vapor separator has an inlet configured to receive fluid from the high pressure vapor cooling passage. The cold vapor separator has a cold vapor separator vapor outlet configured to direct vapor to the cold separator vapor cooling passage and a cold vapor separator liquid outlet configured to direct liquid to the cold separator liquid cooling passage. A first expansion device is configured to receive and expand fluid from the cold separator vapor cooling passage and to direct expanded fluid to the pre-cooling refrigerant passage. The high pressure liquid cooling passage and the cold separator liquid cooling passage are each in fluid communication with the pre-cooling refrigeration passage. The cooling passage configured so that hydrogen therein is cooled by countercurrent heat exchange with pre-cooling mixed refrigerant in the pre-cooling refrigeration passage.

In another aspect, a process for liquefying a hydrogen gas feed stream includes the steps of pre-cooling the hydrogen gas feed stream using a mixed refrigerant by compressing and cooling a mixed refrigerant stream to form a high pressure mixed refrigerant stream, separating the high pressure mixed refrigerant stream to form a high pressure mixed refrigerant vapor stream and a high pressure mixed refrigerant liquid stream, cooling the high pressure mixed refrigerant vapor stream in a heat exchanger, to form a mixed phase stream, separating the mixed phase stream with a cold vapor separator, to form a cold separator vapor stream and a cold separator liquid stream, condensing the cold separator vapor stream and flashing, to form a cold temperature refrigerant stream, cooling the high pressure mixed refrigerant liquid stream in the heat exchanger, to form a cooled high pressure mixed refrigerant liquid stream, cooling the cold separator liquid stream to form a cooled cold separator liquid stream and combining the cooled cold separator liquid stream with the cooled high pressure mixed refrigerant liquid stream, to form a middle temperature refrigerant stream, combining the middle temperature refrigerant stream and the cold temperature refrigerant stream to form a combined pre-cool refrigerant stream, thermally contacting the hydrogen gas feed stream with the combined pre-cool refrigerant stream in the heat exchanger to form a pre-cooled hydrogen gas feed stream. The process further includes the steps of liquefying the pre-cooled hydrogen gas feed stream using a primary refrigerant by compressing and cooling a first vaporized primary refrigerant and a second vaporized primary refrigerant to form a high pressure primary refrigerant, expanding the high pressure primary refrigerant in a warm expander to form a first expanded primary refrigerant, expanding the high pressure primary refrigerant in a cold expander to form a second expanded primary refrigerant, thermally contacting the pre-cooled hydrogen gas feed stream with the first and second expanded refrigerants to form first and second vaporized primary refrigerants and a liquefied hydrogen stream.

In another aspect, a system for liquefying hydrogen gas feed includes a heat exchanger system having a feed gas inlet configured to receive the hydrogen gas feed stream, a product outlet, a cooling passage in fluid communication with the feed gas inlet and the product outlet, a primary refrigerant feed passage, a primary refrigeration passage and a pre-cooling refrigeration passage. A primary refrigerant compression system is configured to direct a conditioned primary refrigerant to the primary refrigerant feed passage. A warm expander is in fluid communication with the primary refrigerant feed passage and has a warm expander outlet in fluid communication with the heat exchanger system and the primary refrigerant compression system. A cold expander is in fluid communication with the primary refrigerant feed passage and has a cold expander outlet in fluid communication with the primary refrigeration passage. An intermediate cooling passage within the heat exchanger system is in fluid communication with the warm expander and the cold expander. The cooling passage is configured so that hydrogen therein is cooled and liquefied by countercurrent heat exchange with primary refrigerant in the primary refrigeration passage. The primary refrigerant compression system is configured to receive, compress and cool vaporized primary refrigerant from the primary refrigeration passage so that a conditioned primary refrigerant is provided. A pre-cooling refrigerant compression system is configured to receive, compress and cool a pre-cooling refrigerant vapor from an outlet of the pre-cooling refrigerant passage so that a conditioned pre-cooling refrigerant is provided to an inlet of the pre-cooling refrigerant passage. The cooling passage is configured so that hydrogen therein is cooled by countercurrent heat exchange with pre-cooling refrigerant in the pre-cooling refrigeration passage.

In a further aspect, a system for liquefying hydrogen gas feed includes a heat exchanger system having a feed gas inlet configured to receive the hydrogen gas feed stream, a product outlet, a cooling passage in fluid communication with the feed gas inlet and the product outlet, a primary refrigerant feed passage, a first primary refrigeration passage, a second primary refrigeration passage and a pre-cooling refrigeration passage. A primary refrigerant compression system is configured to direct a conditioned primary refrigerant to the primary refrigerant feed passage. A warm expander is configured to receive a first portion of primary refrigerant from the primary refrigerant feed passage and direct fluid to the first primary refrigeration passage. A first cold expander is configured to receive a second portion of primary refrigerant from the primary refrigerant feed passage. A second cold expander is configured to direct fluid to the second primary refrigeration passage. An intermediate cooling passage within the heat exchanger system is configured to receive and cool fluid from the first cold expander and to direct fluid to the second cold expander. The cooling passage is configured so that hydrogen therein is cooled and liquefied by countercurrent heat exchange with primary refrigerant in the first and second primary refrigeration passages. The primary refrigerant compression system is configured to receive, compress and cool vaporized primary refrigerant from the first and second primary refrigeration passages so that a conditioned primary refrigerant is provided. A pre-cooling refrigerant compression system is configured to receive, compress and cool a pre-cooling refrigerant vapor from an outlet of the pre-cooling refrigerant passage so that a conditioned pre-cooling refrigerant is provided to an inlet of the pre-cooling refrigerant passage. The cooling passage is configured so that hydrogen therein is cooled by countercurrent heat exchange with pre-cooling refrigerant in the pre-cooling refrigeration passage. A primary feed expansion device is configured to receive and expand a third portion of primary refrigerant that has been further cooled in the primary refrigerant feed passage and direct an expanded third portion of the primary refrigerant to the heat exchanger system.

In a further aspect, a system for liquefying hydrogen gas feed includes a heat exchanger system having a feed gas inlet configured to receive the hydrogen gas feed stream, a product outlet, a cooling passage in fluid communication with the feed gas inlet and the product outlet, a primary refrigerant feed passage, a first primary refrigeration passage, a second primary refrigeration passage and a pre-cooling refrigeration passage. A primary refrigerant compression system is configured to direct a conditioned primary refrigerant to the primary refrigerant feed passage. A first warm expander is configured to receive a first portion of primary refrigerant from the primary refrigerant feed passage. A second warm expander is configured to direct fluid to the first primary refrigeration passage. An intermediate cooling passage within the heat exchanger system is configured to receive and cool fluid from the first warm expander and to direct fluid to the second warm expander. A cold expander is configured to receive a second portion of primary refrigerant from the primary refrigerant feed passage and direct an expanded second portion of primary refrigerant to the second primary refrigeration passage. The cooling passage is configured so that hydrogen therein is cooled and liquefied by countercurrent heat exchange with primary refrigerant in the first and second primary refrigeration passages. The primary refrigerant compression system is configured to receive, compress and cool vaporized primary refrigerant from the first and second primary refrigeration passages so that a conditioned primary refrigerant is provided. A pre-cooling refrigerant compression system configured to receive, compress and cool a pre-cooling refrigerant vapor from an outlet of the pre-cooling refrigerant passage so that a conditioned pre-cooling refrigerant is provided to an inlet of the pre-cooling refrigerant passage. The cooling passage is configured so that hydrogen therein is cooled by countercurrent heat exchange with pre-cooling refrigerant in the pre-cooling refrigeration passage. A primary feed expansion device is configured to receive and expand a third portion of primary refrigerant that has been further cooled in the primary refrigerant feed passage and direct an expanded third portion of the primary refrigerant to the heat exchanger system.

DETAILED DESCRIPTION OF EMBODIMENTS

Figure 1:
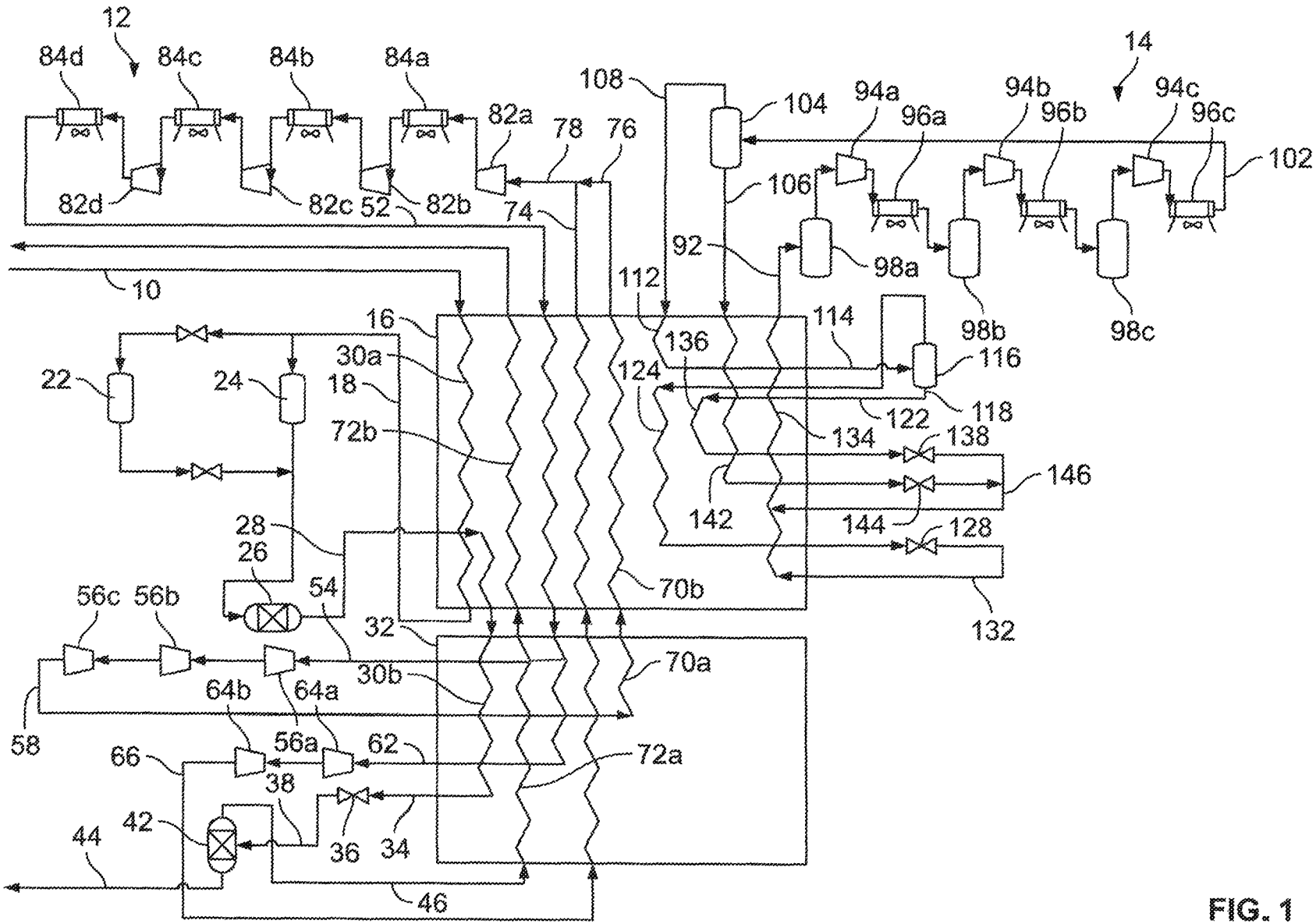
FIG. 1 is a process flow diagram and schematic illustrating a first embodiment of the hydrogen liquefaction process and system of the disclosure.

A first embodiment of the hydrogen liquefaction system of the disclosure is illustrated in FIG. 1. The system liquefies a hydrogen gas feed stream 10 in one or more heat exchangers using a primary or main cooling loop, indicated in general at 12, and a pre-cooling loop, indicated in general at 14. The primary cooling loop 12 uses hydrogen as the refrigerant, but may alternatively use, as examples only, helium, a mixture of neon and helium, a mixture of neon, helium and hydrogen or a mixture of hydrogen and helium. The pre-cooling loop 14 uses a mixed refrigerant but, as will be described below, alternative embodiments of the disclosure may use, as an example only, nitrogen as the pre-cooling refrigerant.

The pre-cooling loop 14 cools the hydrogen feed stream 10 to around 80-90 K and may use the mixed refrigerant refrigeration systems and processes disclosed in U.S. Pat. No. 9,441,877 to Gushanas et al. or U.S. Pat. No. 10,480,851 to Ducote et al., the contents of each of which are hereby incorporated by reference. The main cooling loop 12 further cools the hydrogen to approximately 20 K.

With reference to FIG. 1, the hydrogen gas feed stream 10 is cooled in a first portion of a cooling passage 30*a* of a warm heat exchanger 16 which, as an example only, may be a brazed aluminum heat exchanger, such as is available from Chart Energy & Chemicals, Inc. of Ball Ground, Georgia.

It should be noted herein that the passages (both internal and external to a heat exchanger) and streams are sometimes both referred to by the same element number set out in the figures. Also, as used herein, and as known in the art, a heat exchanger is that device or an area in the device wherein indirect heat exchange occurs between two or more streams at different temperatures, or between a stream and the environment. As used herein, the terms "communication", "communicating", and the like generally refer to fluid communication unless otherwise specified. Furthermore, although two fluids in communication may exchange heat upon mixing, such an exchange would not be considered to be the same as heat exchange in a heat exchanger. As used herein, the term "reducing the pressure of" (or variations thereof) does not involve a phase change, while the term "flashing" (or variations thereof) involves a phase change, including even a partial phase change. As used herein, the terms, "high", "middle", "warm" and the like are relative to comparable streams, as is customary in the art.

The cooled stream 18 exits the warm heat exchanger 16 may be directed to either one of adsorbent vessels 22 and 24. The vessels preferably are operated one at a time so that all of the flow goes through one vessel, and when it is exhausted, the flow is redirected to the other vessel. The exhausted vessel is then regenerated and ready for use when the vessel being operated is exhausted. As examples only, adsorbent vessels 22 and 24 may be, or are similar to, mole-sieve vessels or they may be silica gel vessels. The vessels 22 and 24 are designed to remove small amounts of contaminants that will freeze in the cold steps of hydrogen liquefaction. The contaminants are in the parts per million range (usually less than 20 ppm). These contaminants may include nitrogen, argon, oxygen, hydrocarbons, carbon dioxide, etc. The streams exiting vessels 22 and 24 are recombined and directed to a catalyst vessel 26. The catalyst is used to convert the hydrogen from the ortho state of hydrogen to the para state of hydrogen. Suitable catalysts are well known in the art. The catalyst can be installed, as shown in FIG. 1, in a separate vessel from the heat exchanger or the catalyst can be placed in the heat exchanger 16, or in multiple vessels along the heat exchanger as the hydrogen cools or in numerous other locations as known in the art.

In an alternative embodiment, the catalyst may be positioned within the passages of the warm heat exchanger 16 and/or a cold heat exchanger 32 through which the hydrogen fluid flows so that the conversion of the hydrogen from ortho to para states can be done at the same time the hydrogen is being cooled and liquefied.

Continuing with FIG. 1, the stream 28 exiting the catalyst vessel 26 is further cooled and liquefied as it passes through a second portion of a cooling passage 30*b* the warm and cold heat exchangers 16 and 32, respectively, with a liquid hydrogen stream 34 exiting the cold heat exchanger 32. As an example only, the warm heat exchanger 16 may be used to handle streams above 80 K, while the cold heat exchanger 32 may be used to handle streams below/colder than 80 K.

Stream 34 is expanded or flashed via expansion device 36, which may be a Joule-Thomson (JT) valve or other expansion device, with the resulting mixed phase stream 38 entering separation device 42. The resulting liquid stream 44 exits the separation device 42 and is directed out of the system for use, transport of storage. A vapor stream 46 exits the separation device 42 and is directed back through the cold and warm heat exchangers to recover refrigeration and help refrigerate the hydrogen feed stream.

Similar to catalyst vessel 26, the separation device separation device 42 may contain a catalyst material.

It should be noted that while two heat exchangers are illustrated (warm heat exchanger 16 and cold heat exchanger 32) as a heat exchanger system, a single heat exchanger, having a warm end and a cold end, alternatively may be used as the heat exchanger system or greater than two heat exchangers alternatively may be used as the heat exchanger system.

The main cooling loop 12 provides a stream 52 of hydrogen refrigerant gas (as examples only, helium, or a mixture of neon and helium, or a mixture of neon, helium or hydrogen or a mixture of helium and hydrogen may be used in alternative embodiments) that has been compressed to a high pressure (as an example around 400 to 800 psig) to the warm heat exchanger 16 and the cold heat exchanger 32 where it is cooled. After entering the cold heat exchanger 32, the stream is split so that a first portion 54 is directed to a series of warm expanders 56*a*, 56*b* and 56*c* while a second portion, after further cooling in the cold heat exchanger 32, is directed as stream 62 to a series of cold expanders 64*a* and 64*b* (both the warm and the cold expanders are shown as 3 and 2 expanders respectively, but may be less or more than these numbers). While a series of warm expanders and a series of cold expanders are illustrated in the embodiment of FIG. 1, there instead may be a single warm expander or other expansion device in place of the series of warm expanders 56*a*-56*c* and a single cold expander or other expansion device in place of the series of cold expanders 64*a* and 64*b*. The same applies to the embodiments of the remaining figures. Furthermore, in embodiments where there are multiple warm expansion devices, the warm expansion devices may be arranged in parallel. Similarly, in embodiments where there are multiple cold expansion devices, the cold expansion devices may be arranged in parallel.

As examples only, the warm expander(s) 56*a*, 56*b* and 56*c* and the cold expander(s) 64*a* and 64*b* may be turbines, Joule Thomson (JT) valves and/or other devices used as expanders or expansion devices in the art. The terms "expander" and "expansion device" are used herein interchangeably and are treated as having the same meaning. The series of warm expanders and/or the series of cold expanders may each or both also be a mix of expander or expansion device types (for example, a turbine followed by a JT valve in series, etc.) The series of "warm" hydrogen expander steps (in warm expanders 56*a*, 56*b* and 56*c*) preferably take place colder than 80 K with a stream 58 being produced which is colder than the inlet temperature to the first warm expander (56*a*). The series of "cold" hydrogen expander steps (in cold expanders 64*a* and 64*b*) preferably take place at temperatures where the liquid stream 66 exiting from the "cold" hydrogen expander series is close to 20 K.

The hydrogen streams 58 and 66 are directed through corresponding first primary refrigeration passages 70*a* and 70*b* (in cold and warm heat exchangers 32 and 16, respectively) and second primary refrigeration passages 72*a* and 72*b* (in cold and warm heat exchangers 32 and 16, respectively) to cool and liquefy the hydrogen feed stream 10 in cooling passages 30*a* and 30*b* via countercurrent heat exchange (thermal contact). In an alternative embodiment, the first and second primary refrigeration passages could be combined into a single primary refrigeration passage that passes through both the cold and warm heat exchangers.

Vaporized hydrogen refrigerant streams 74 and 76 exit the warm heat exchanger and are combined into single stream 78 which enters the first compression and cooling stage accomplished using first compressor stage 82*a* and first aftercooler 84*a* (which may use ambient air or an alternative fluid of fluids for cooling). Further compression and cooling stages are performed at 82*b* and 84*b*, 82*c* and 84*c* and 82*d* and 84*d*, with the previously mentioned high-pressure hydrogen refrigerant vapor stream 52 exiting the last stage aftercooler 84*d*. The number of compression and cooling stages may vary from the number illustrated. Indeed, there may instead be only a single compression stage in the embodiment of FIG. 1 and the embodiments of all following figures. Furthermore, in embodiments where there are multiple compression stages, the compression stages may be performed by stages of a single compressor or by a number of individual compressors.

By splitting the mass flow rate of the hydrogen refrigerant between the two expander services (the warm expanders 56*a*-56*c* and the cold expanders 64*a*-64*b*), less power is consumed compared to a single expansion cycle. While four warm expanders in series are preferred, based on the specific enthalpy difference, and two cold expanders in series are preferred, alternative numbers of expanders may be used for each of the warm and cold expander series.

The warm gas streams 74 and 76 exiting the warm heat exchanger 16 from both expander services exit at the same pressure. Alternatively, the warm expander discharge can be mixed with the cold expander discharge (after heating to the same temperature as the warm expander discharge) in order to simplify the heat exchanger layer arrangement.

Turning to the pre-cooling loop 14 of FIG. 1, the mixed refrigerant (MR) used is preferably composed of nitrogen, methane, ethylene, propane and n-butane. Isobutane may be used place of n-butane to provide an additional margin from freezing (ethane may also be used in place of ethylene due to operating needs). As an example only, the pressure of the MR stream 92 may be 28 psig or 2 barg.

Stream 92 enters the first compression and cooling stage accomplished using first compressor stage 94*a* and first aftercooler 96*a* (which may use ambient air or an alternative fluid of fluids for cooling). Further compression and cooling stages are performed at 94*b* and 96*b* and 94*c* and 96*c*. The number of compression and cooling stages may vary from the number illustrated. Indeed, there may instead be only a single compression stage in the pre-cooling loop 14 of the embodiment of FIG. 1 and the embodiments of all following figures. Furthermore, in embodiments where there are multiple compression stages, the compression stages may be performed by stages of a single compressor or by a number of individual compressors. A suction separation device 98*a* is provide at the inlet of compressor 94*a* to protect against liquid entry into the compressor, with similar suction separation device 98*b* and 98*c* provided between the following compression and cooling stages. Furthermore, liquids from the suction separation devices 98*b* and 98*c* of the interstage compression of pre-cooling loop 14 may be sent to warm heat exchanger 16 for cooling, expanded and then returned to the warm heat exchanger to provide refrigeration therein, as illustrated in commonly assigned U.S. Pat. No. 9,441,877 to Gushanas et al.

In preferred embodiments, no liquids are produced in the suction separation devices by staying above the dew point of the MR stream during compression. Therefore, liquids do not need to be pumped or handled thus reducing process complexity and cost.

The cooling provided by the last discharge cooler 96*c* is enough to liquefy part of the MR stream 102. The vapor and liquid present in stream 102 are separated before entering the warm and cold heat exchanger 16. Stream 102 exits the last compression and cooling stage and travels to a high pressure separation device 104 for this purpose.

As an example only, the MR liquid and vapor streams 106 and 108, respectively, exiting the high pressure separation device 104 may be at a pressure of approximately 640 psig.

The warm heat exchanger 16 includes a high pressure vapor cooling passage 112 that cools the high pressure MR vapor stream 108 to form a mixed phase cold separator MR feed stream 114. The mixed phase cold separator MR feed stream 114 is directed to a cold vapor separator 116. The cold vapor separator 116 separates the cold separator feed stream 114 into a cold separator MR vapor stream 118 and a cold separator MR liquid stream 122.

The warm heat exchanger 16 also includes a cold separator vapor cooling passage 124 having an inlet in communication with the cold vapor separator 116 so as to receive the cold separator MR vapor stream 118. The cold separator MR vapor stream is cooled in passage 124 to form condensed cold temperature MR stream 126, which is flashed with expansion device 128 to form expanded cold temperature MR stream 132 which is directed to the pre-cooling refrigeration passage 134. The MR stream flowing through pre-cooling refrigeration passage 134 of the warm heat exchanger 16 provides pre-cooling to the hydrogen gas feed stream 10 that is within the first portion of the cooling passage 30*a* by countercurrent heat exchange.

Expansion device 128 (and as in the case with all "expansion devices" or "expanders" disclosed herein) may be, as non-limiting examples, a valve (such as a Joule Thompson valve), a turbine or a restrictive orifice.

The cold separator MR liquid stream 122 is cooled in cold separator liquid cooling passage 136 to form a subcooled cold separator MR liquid stream which is flashed in expansion device 138.

A high pressure liquid cooling passage 142 cools high pressure MR liquid stream 106 to form a subcooled high pressure MR liquid stream which is flashed in expansion device 144. The streams exiting expansion devices 138 and 144 are combined to form middle temperature stream 146 which is directed to the pre-cooling refrigeration passage 134. In an alternative embodiment, expansion devices 138 and 144 may be eliminated and replaced with a single expansion device for stream 146 so that the combined streams 136 and 142 are expanded.

Figure 2:
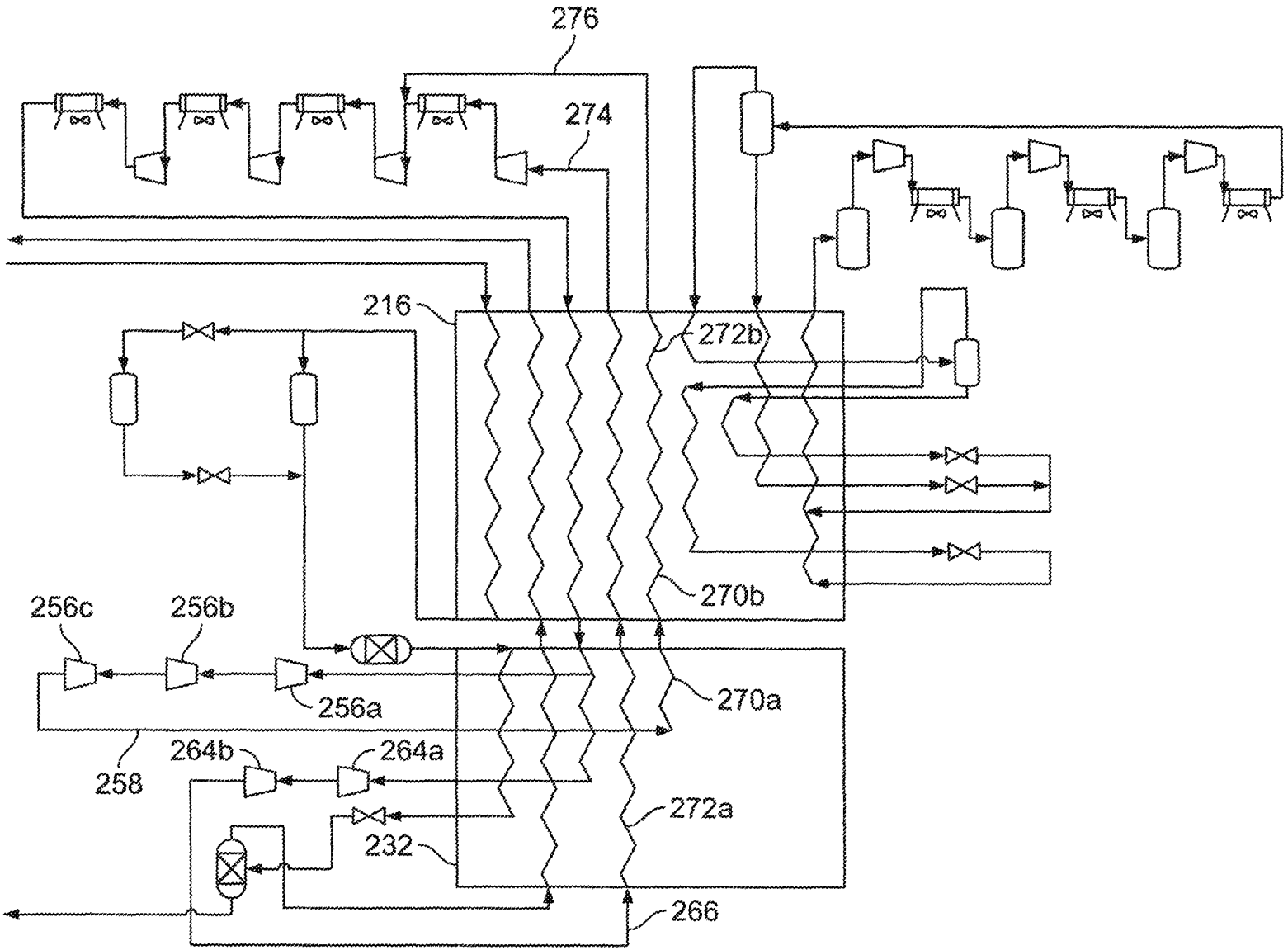
FIG. 2 is a process flow diagram and schematic illustrating a second embodiment of the hydrogen liquefaction process and system of the disclosure.

In a second embodiment of the system of the disclosure illustrated in FIG. 2, in a modified version of the system of FIG. 1, the hydrogen refrigerant is expanded to form hydrogen refrigerant streams 258 and 266 having two different pressures, with streams 258 and 266 going through the warm and cold heat exchangers 216 and 232 in separate passages 270*a*, 270*b* and 272*a*, 272*b*, respectively. As illustrated in FIG. 2, the resulting vapor streams 274 and 276 are directed to two different locations in the compression stages. This may slightly increase the process efficiency and reduce the specific enthalpy difference across the warm expander(s). The lower specific enthalpy difference across the expander (s) will tend to improve the efficiency of the expander(s).

Figure 3:
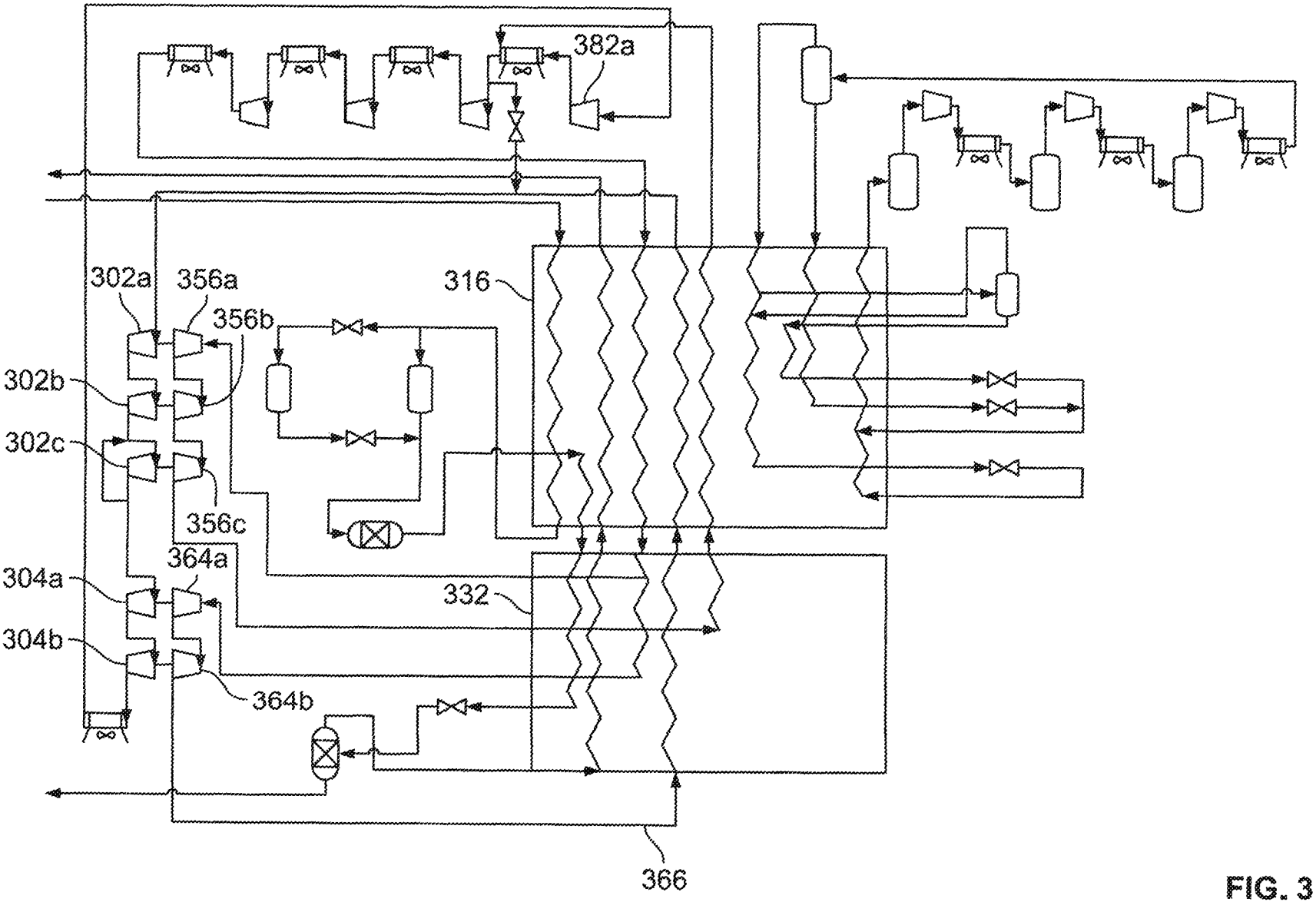
FIG. 3 is a process flow diagram and schematic illustrating a third embodiment of the hydrogen liquefaction process and system of the disclosure.

Furthermore, in the embodiment of FIG. 2, the warm expanders 256*a*, 256*b* and 256*c* and the cold expanders 264*a* and 264*b* may be braked in some manner. Alternatively, with reference to FIG. 3, the power from the warm expanders 356*a*, 356*b* and 356*c* and the cold expanders 364*a* and 364*b* is used to recompress the hydrogen refrigerant stream 366 from the cold expanders 364*a* and 364*b*, after stream 366 provides refrigeration in warm and cold heat exchangers 316 and 332, via conditioning compressors 302*a*, 302*b*, 302*c* and 304*a* and 304*b* prior to entry into the first compressor stage 382*a*. The remainder of the system of FIG. 3 is the same as FIG. 2.

Figure 4:
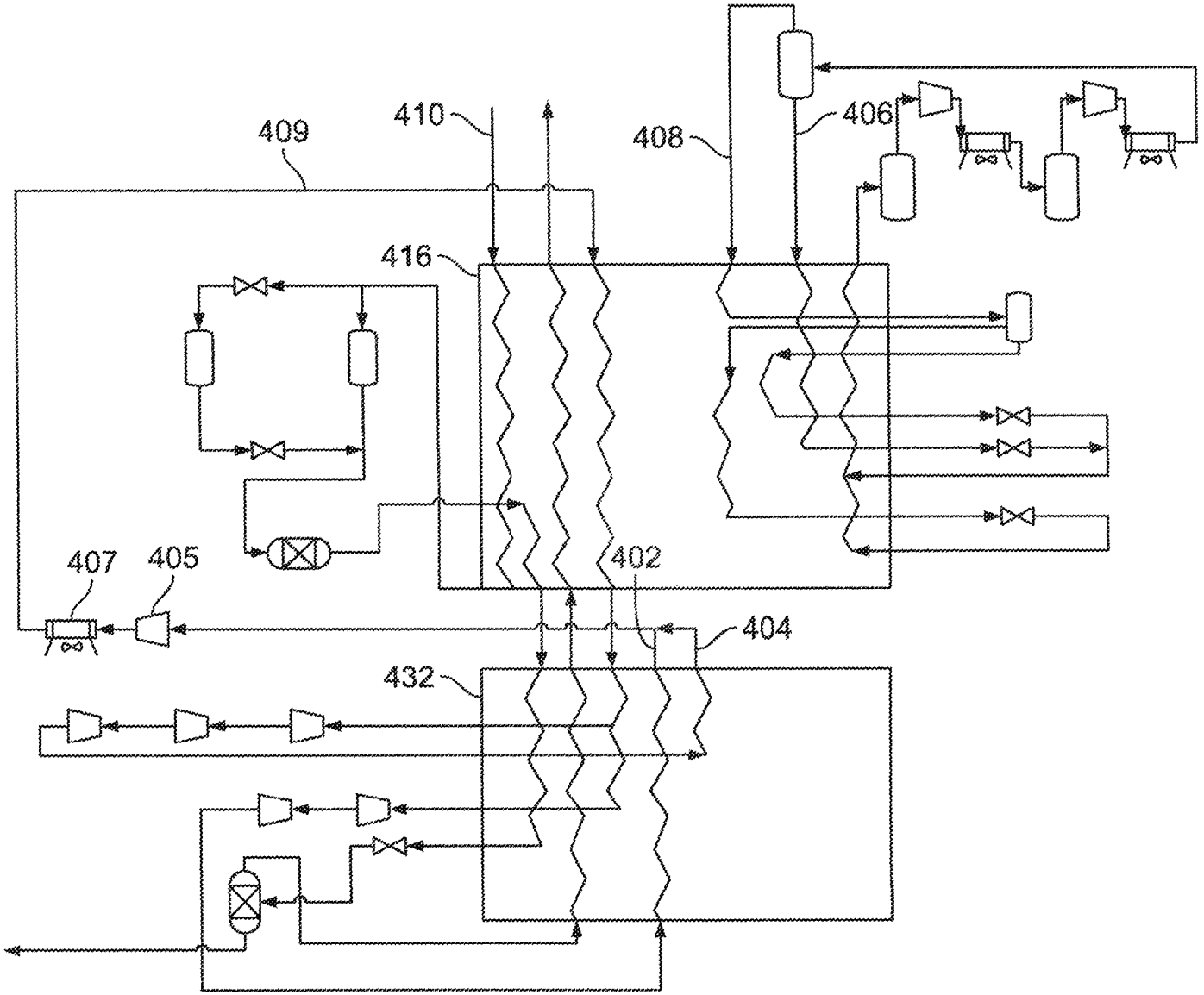
FIG. 4 is a process flow diagram and schematic illustrating a fourth embodiment of the hydrogen liquefaction process and system of the disclosure.

In the embodiment of FIG. 4, the two hydrogen refrigerant streams 402 and 404, after providing refrigeration in the cold heat exchanger 432, are combined and then compressed via compressor 405 after leaving the cold heat exchanger 432 as vapor so that cold temperature compression is accomplished. The compressed stream is directed to aftercooler 407 with the resulting stream 409 directed into warm heat exchanger 416 for cooling.

The hydrogen refrigerant streams 402 and 404 withdrawn at the MR cold end temperature (which may be, as an example only, approximately 120 K) and may be compressed via compressor 406, as an example only, to 700 to 1200 psig, dependent on compressor type for compressor 405 and suction temperature. This choice of temperature and pressure allows for the hydrogen stream 409 to be fed to the warm heat exchanger 416 along with the hydrogen gas feed stream 410 and the high pressure MR liquid and vapor streams 406 and 408.

Figure 5:
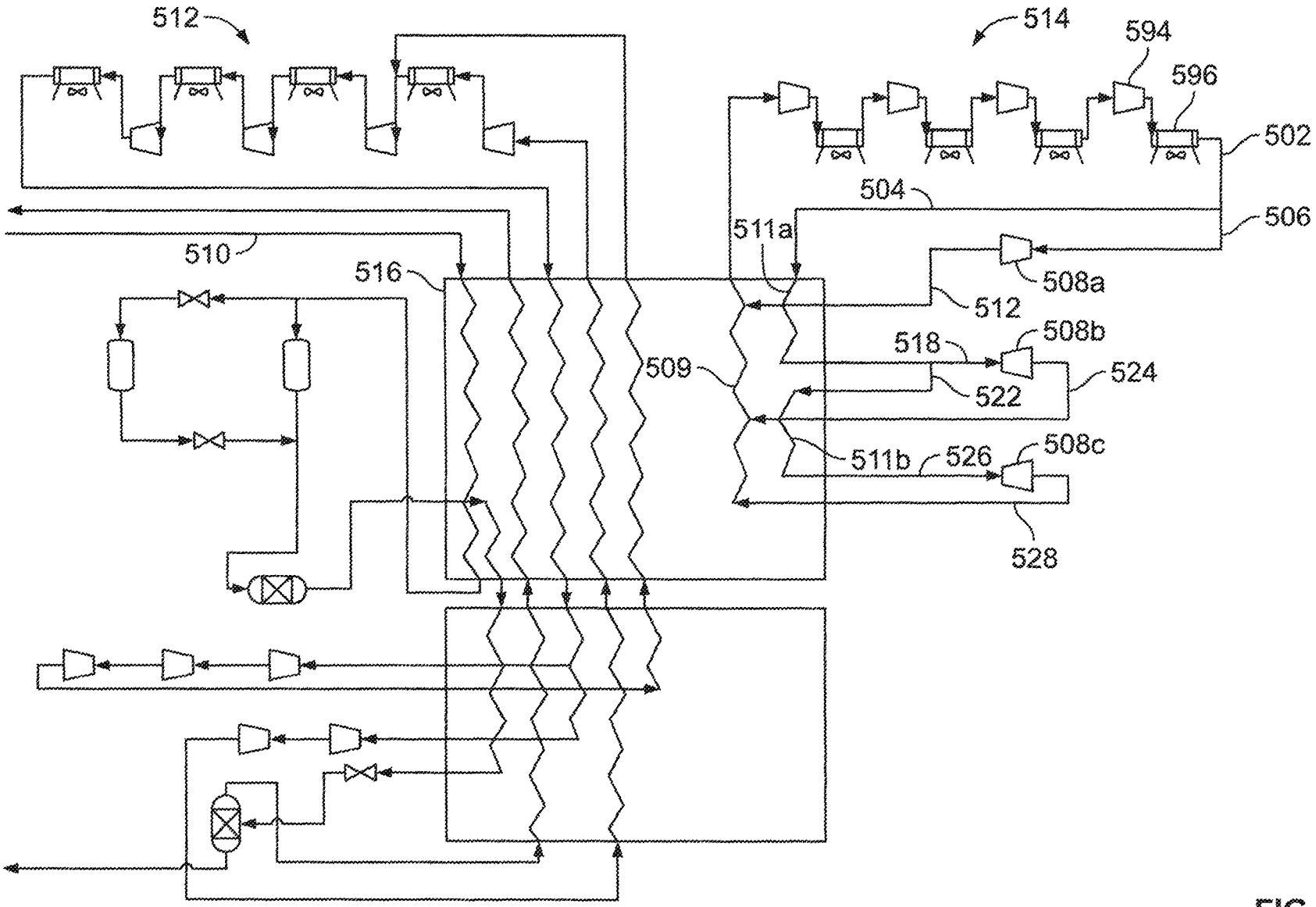
FIG. 5 is a process flow diagram and schematic illustrating a fifth embodiment of the hydrogen liquefaction process and system of the disclosure.

In the system of FIG. 5, while the main cooling loop 512 is the same as the main cooling loop 12 of FIG. 1, nitrogen is used as the refrigerant in the pre-cooling loop 514. The nitrogen refrigerant stream 502 exiting the last compression and cooling stage (compressor 594 and aftercooler 596) is split into streams 504 and 506. Stream 506 is expanded in expander 508*a* and then directed to the pre-cooling refrigeration passage 509 as stream 512. Stream 504 is further cooled in a pre-cooling refrigerant conditioning passage 511*a* within the warm heat exchanger 516 with the resulting stream split into streams 518 and 522. Stream 518 is expanded in expander 508*b* and then directed to the pre-cooling refrigeration passage 509 as stream 524. Stream 522 is further cooled in a pre-cooling refrigerant conditioning passage 511*b* in the warm heat exchanger 516 with the resulting stream 526 expanded in expander 508*c* and then directed to the pre-cooling refrigeration passage 509 as stream 528.

Expanders 508*a*-508*c* may be turbines or other devices used as expanders or expansion devices in the art The system of FIG. 5 therefore uses nitrogen expansion to pre-cool the hydrogen gas feed stream 510 instead of the mixed refrigerant of FIGS. 1-4. The nitrogen expansion process is typically more efficient than the liquid nitrogen process In the system of FIG. 6, the main cooling loop 612 provides a stream 652 of hydrogen refrigerant gas (as examples only, helium, or a mixture of neon and helium, or a mixture of neon, helium or hydrogen or a mixture of helium and hydrogen may be used in alternative embodiments) to a warm heat exchanger 616 and a cold heat exchanger 632 where it is cooled. After entering the cold heat exchanger 632, a portion 654 of the stream is split and directed to a warm expander 656. The resulting expanded refrigerant stream is directed through intermediate cooling passage 661 of cold heat exchanger 632. The resulting cooled stream is directed to cold expander 664. The further cooled and expanded hydrogen stream 669 is directed through primary refrigeration passages 672*a* and 672*b* (in cold and warm heat exchangers 632 and 616, respectively) to cool and liquefy the hydrogen gas feed stream 610 in cooling passages 630*a* and 630*b* via countercurrent heat exchange. A vaporized primary refrigerant stream 674 is returned to the compression system of the main cooling loop.

A remaining portion 682 of the hydrogen refrigerant stream is further cooled in the cold heat exchanger and then, after exiting the heat exchanger, is expanded via a primary feed expansion device, such as JT valve 684. The resulting expanded fluid 685 is directed back through refrigeration passages 687*a* and 687*b* of the cold and warm heat exchangers to provide refrigeration therein. A resulting vaporized refrigerant stream is directed back to the compression system of the main cooling loop 612.

Figure 6:
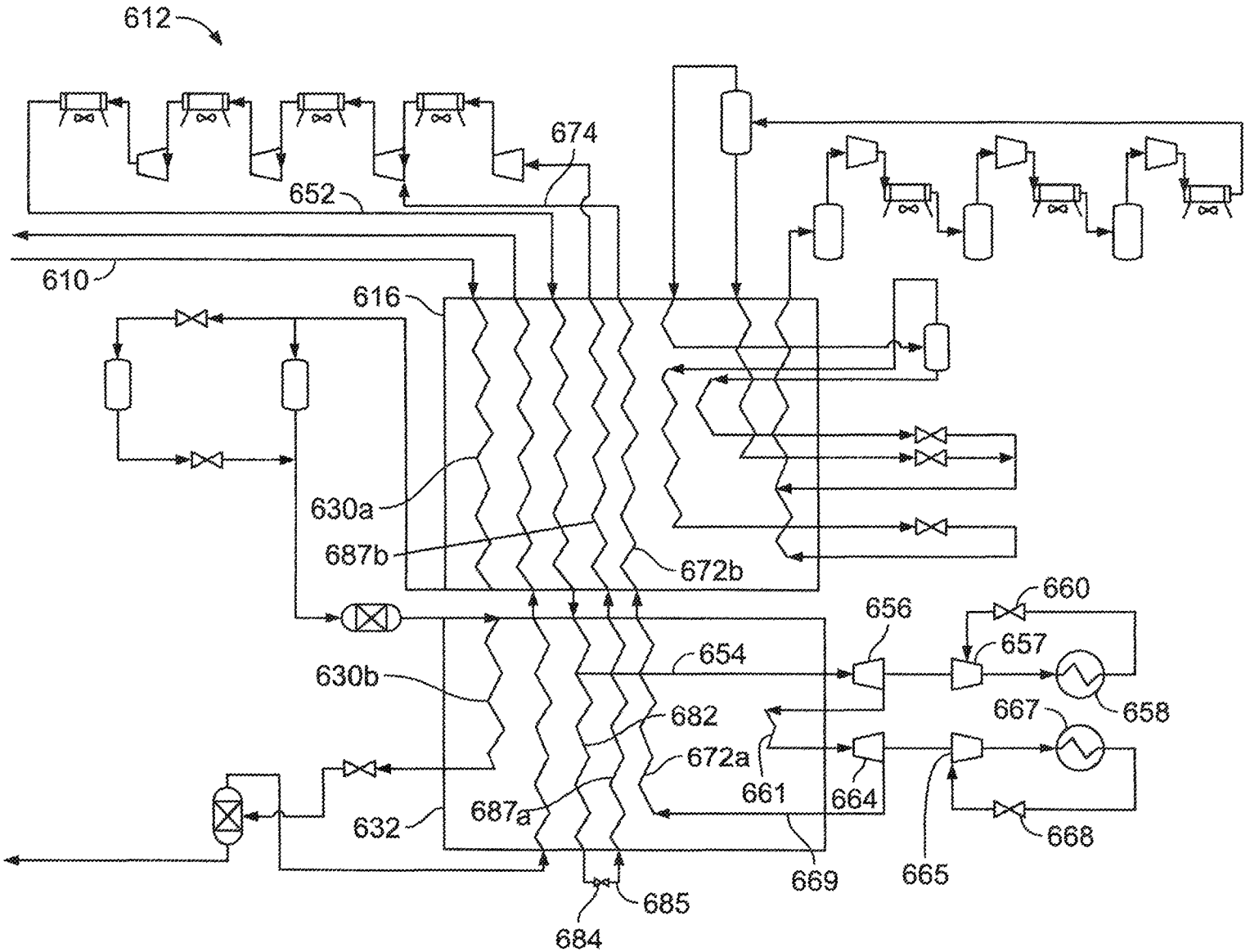
FIG. 6 is a process flow diagram and schematic illustrating a sixth embodiment of the hydrogen liquefaction process and system of the disclosure.

Warm expander 656 and the cold expander 664 perform work by powering compressors 657 and 665, respectively. Alternatively, the expanders can power generators also or also be connected to brakes. After compression in compressor 657, a working fluid is cooled in aftercooler 658 and then expanded in an expansion device, such as JT valve 660, with the resulting stream returned to the compressor. Similarly, after compression in compressor 665, a working fluid is cooled in aftercooler 667 and then expanded in an expansion device, such as JT valve 668, with the resulting stream returned to the compressor. The remainder of the system of FIG. 6 is the same as the system of FIG. 1. While a mixed refrigerant pre-cooling loop is illustrated in FIG. 6, (and FIG. 1) pre-cooling loops using alternative refrigerants including, but not limited to, nitrogen, may be used instead, both in FIG. 6 and all embodiments presented in the remaining figures. The cold vapor separator device (116 in FIG. 1) may also be eliminated from the pre-cooling loop of FIG. 6 and all embodiments presented in the remaining figures.

Figure 7:
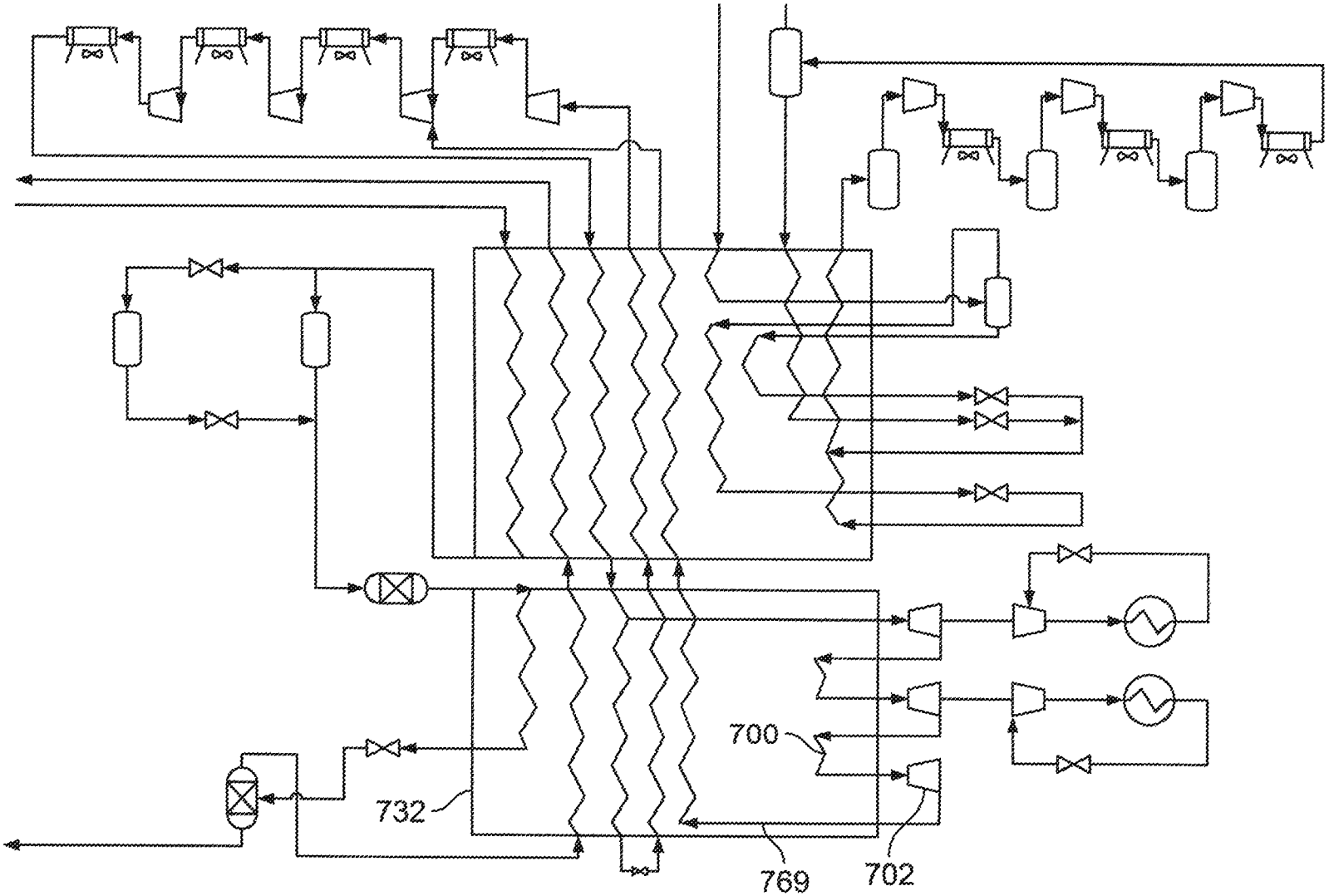
FIG. 7 is a process flow diagram and schematic illustrating a seventh embodiment of the hydrogen liquefaction process and system of the disclosure.

The system of FIG. 7 adds a supplemental intermediate cooling passage 700 to the cold heat exchanger 732 and a supplemental cold expansion device 702 to the system of FIG. 6. As a result, hydrogen refrigerant stream 769 has undergone a further cooling and expansion stage (as compared to stream 669 of FIG. 6). The remainder of the system of FIG. 7 is the same as the system of FIG. 6.

Figure 8:
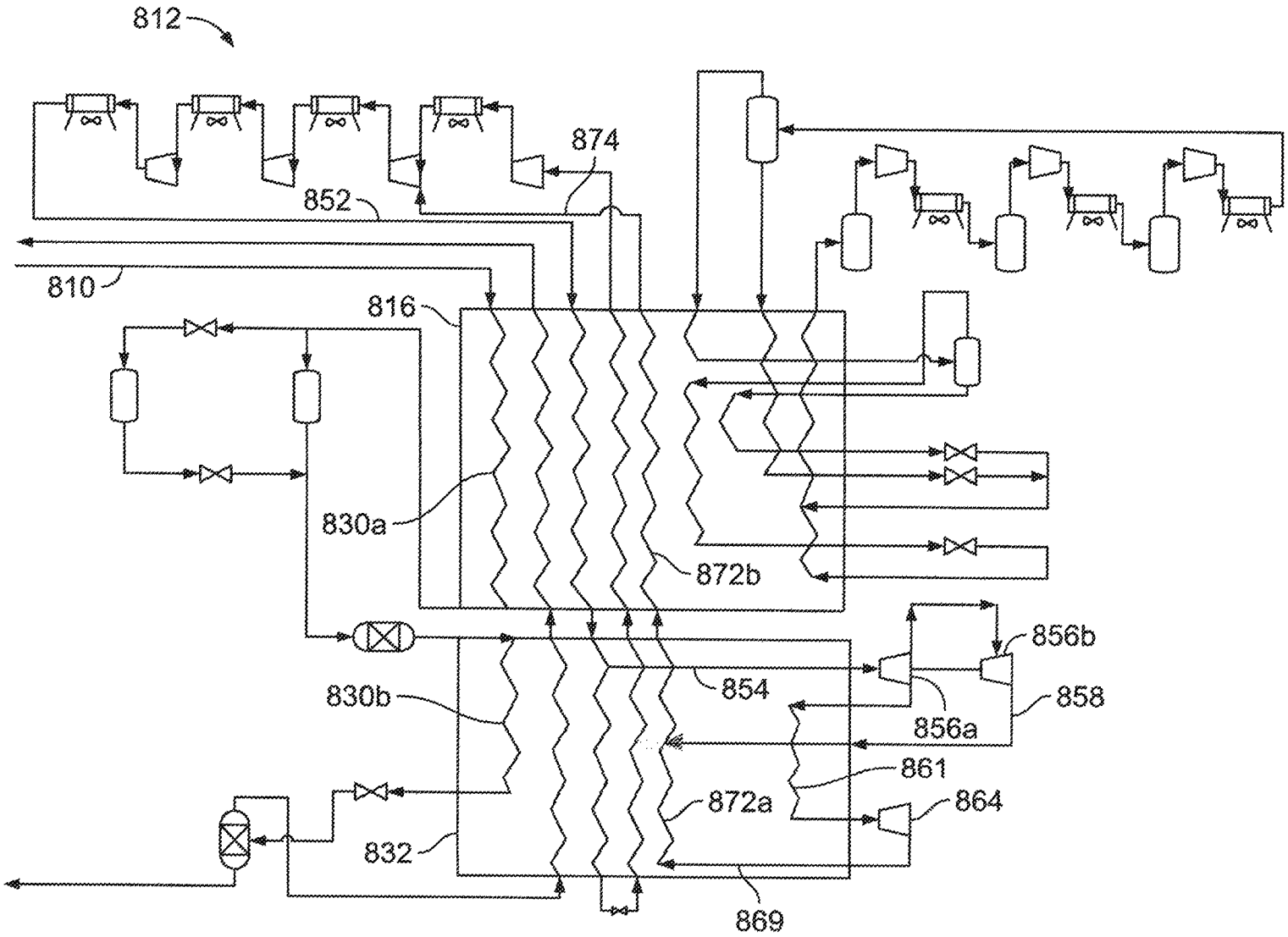
FIG. 8 is a process flow diagram and schematic illustrating an eighth embodiment of the hydrogen liquefaction process and system of the disclosure.

A further alternative arrangement of the warm and cold expanders of the main cooling loop is presented in FIG. 8. In the system of FIG. 8, the main cooling loop 812 provides a stream 852 of hydrogen refrigerant gas (as examples only, helium or a mixture of neon and helium or a mixture of neon, helium and hydrogen or a mixture of helium and hydrogen may be used in alternative embodiments) to a warm heat exchanger 816 and a cold heat exchanger 832 where it is cooled. After entering the cold heat exchanger 832, a portion 854 of the stream is split and directed to a first warm expander 856*a*. A first portion of the expanded refrigerant stream exiting warm expander 856*a* is directed to a second warm expander 856*b*. The expanded refrigerant stream 858 exiting second warm expander 856*b* is directed to primary refrigeration passages 872*a* and 872*b* of heat exchangers 832 ad 816, respectively.

As illustrated in FIG. 8, a second portion of the expanded refrigerant stream exiting warm expander 856*a* is directed through intermediate cooling passage 861 of cold heat exchanger 832. The resulting cooled stream is directed to cold expander 864. The further cooled and expanded hydrogen stream 869 is directed through primary refrigeration passages 872*a* and 872*b* (in cold and warm heat exchangers 832 and 816, respectively) to cool and liquefy the hydrogen gas feed stream 810 in cooling passages 830*a* and 830*b* via countercurrent heat exchange. A vaporized primary refrigerant stream 874 is returned to the compression system of the main cooling loop. Pre-cooling can performed with a mixed refrigerant, as shown in FIG. 8, or the pre-cooling can be performed with nitrogen using one or more expansion devices. The remainder of the system of FIG. 8 is the same as the systems of FIGS. 6 and 7.

Figure 9:
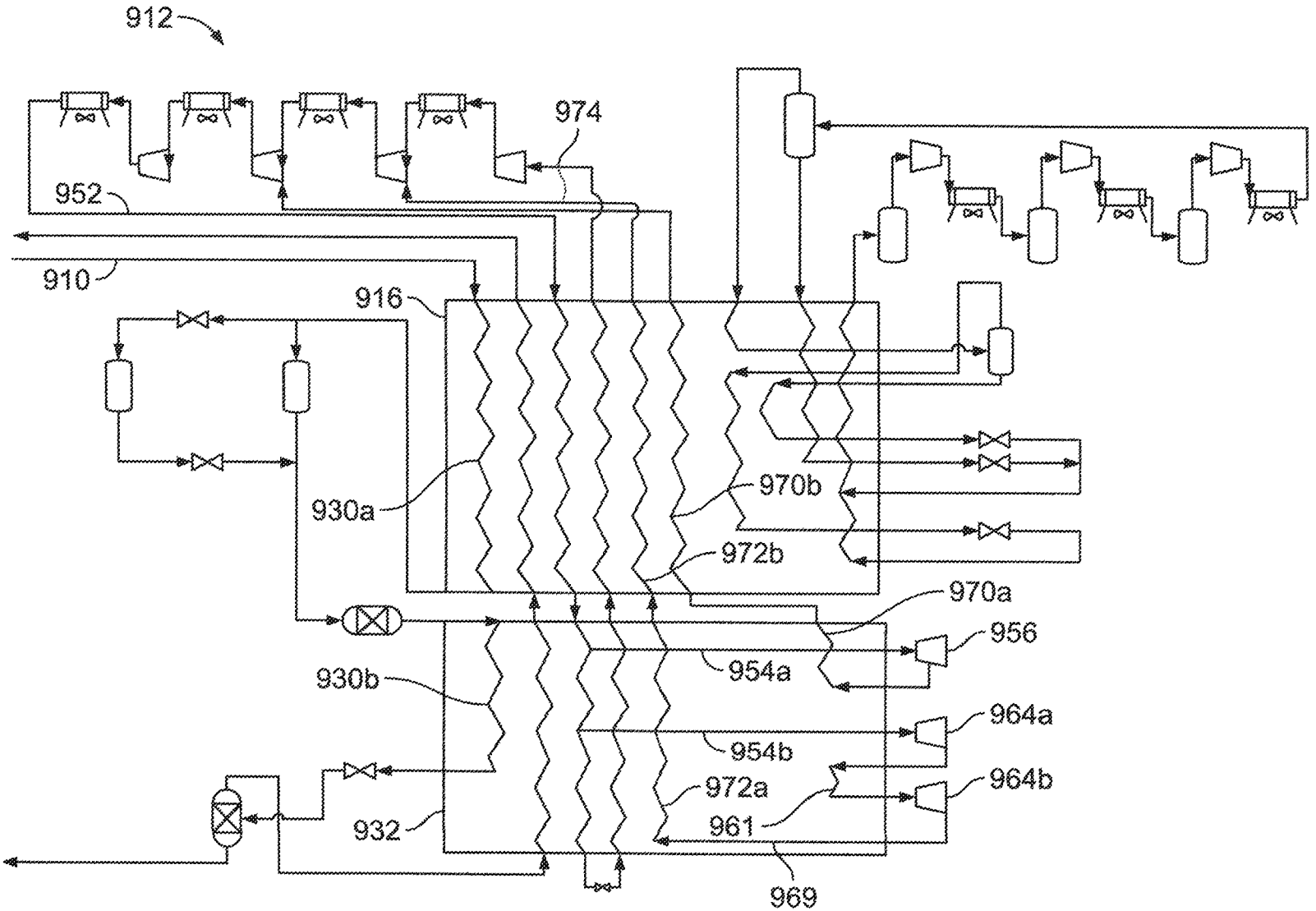
FIG. 9 is a process flow diagram and schematic illustrating a ninth embodiment of the hydrogen liquefaction process and system of the disclosure.

A further alternative arrangement of the warm and cold expanders of the main cooling loop is presented in FIG. 9. In the system of FIG. 9, the main cooling loop 912 provides a stream 952 of hydrogen refrigerant gas (as examples only, helium or a mixture of neon and helium or a mixture of neon, helium and hydrogen or a mixture of helium and hydrogen may be used in alternative embodiments) to a warm heat exchanger 916 and a cold heat exchanger 932 where it is cooled. After entering the cold heat exchanger 932, a first portion 954*a* of the stream is split and directed to a warm expander 956. The resulting expanded refrigerant stream is directed to first primary refrigeration passages 970*a* and 970*b* of cold and warm heat exchangers 932 and 916, respectively, to provide refrigeration therein. A resulting vaporized refrigerant is directed to the compression system of the main cooling loop.

As illustrated in FIG. 9, a second portion 954*b* of the cooled hydrogen refrigerant stream splits and is directed through a first cold expander 964*a*, which directs an expanded refrigerant stream through intermediate cooling passage 961 of cold heat exchanger 932. The resulting cooled stream is directed to second cold expander 964*b*. The further cooled and expanded hydrogen stream 969 is directed through second primary refrigeration passages 972*a* and 972*b* in cold and warm heat exchangers 832 and 816, respectively to cool and liquefy the hydrogen gas feed stream 910 in cooling passages 930*a* and 930*b* via countercurrent heat exchange. A vaporized primary refrigerant stream 974 is returned to the compression system of the main cooling loop. The remainder of the system of FIG. 9 is the same as the systems of FIGS. 6 through 8.

Figure 10:
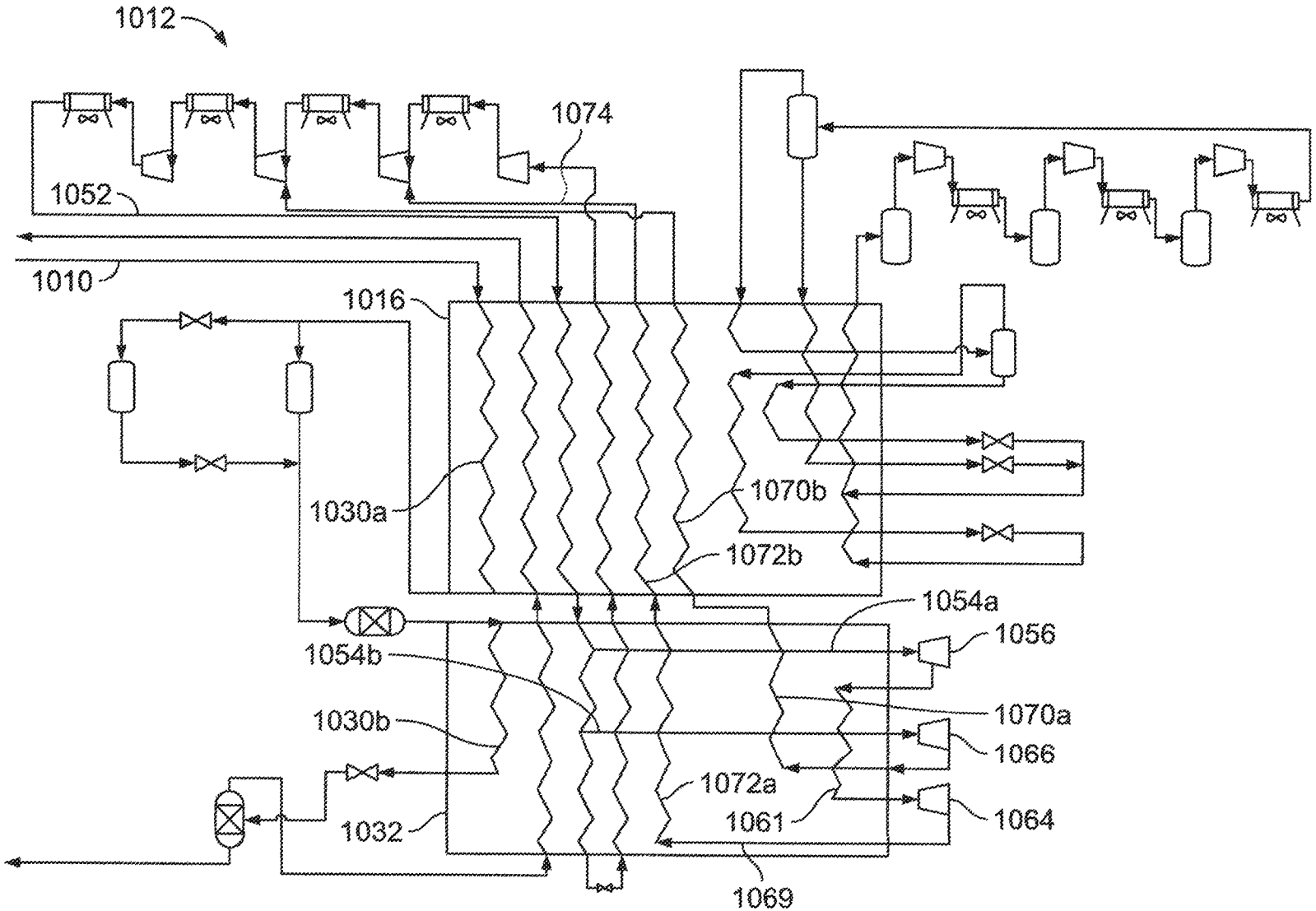
FIG. 10 is a process flow diagram and schematic illustrating a tenth embodiment of the hydrogen liquefaction process and system of the disclosure.

A further alternative arrangement of the warm and cold expanders of the main cooling loop is presented in FIG. 10. In the system of FIG. 10, the main cooling loop 1012 provides a stream 1052 of hydrogen refrigerant gas (as examples only, helium or a mixture of neon and helium or a mixture of neon, helium and hydrogen or a mixture of helium and hydrogen may be used in alternative embodiments) to a warm heat exchanger 1016 and a cold heat exchanger 1032 where it is cooled. After entering the cold heat exchanger 1032, a first portion 1054*a* of the stream is split and directed to a warm expander 1056. The resulting expanded refrigerant stream is directed through intermediate cooling passage 1061 of cold heat exchanger 1032. The resulting cooled stream is directed to cold expander 1064. The further cooled and expanded hydrogen stream 1069 is directed through second primary refrigeration passages 1072*a* and 1072*b* in cold and warm heat exchangers 1032 and 1016, respectively to cool and liquefy the hydrogen gas feed stream 1010 in cooling passages 1030*a* and 1030*b* via countercurrent heat exchange. A vaporized primary refrigerant stream 1074 is returned to the compression system of the main cooling loop.

As further illustrated in FIG. 10, a second portion 1054*b* of the cooled hydrogen refrigerant stream splits and is directed through an intermediate expander 1066. The resulting expanded refrigerant stream is directed to first primary refrigeration passages 1070*a* and 1070*b* of cold and warm heat exchangers 1032 and 1016, respectively, to provide refrigeration therein. A resulting vaporized refrigerant is directed to the compression system of the main cooling loop 1012.

The remainder of the system of FIG. 10 is the same as the systems of FIGS. 6 through 9.

Figure 11:
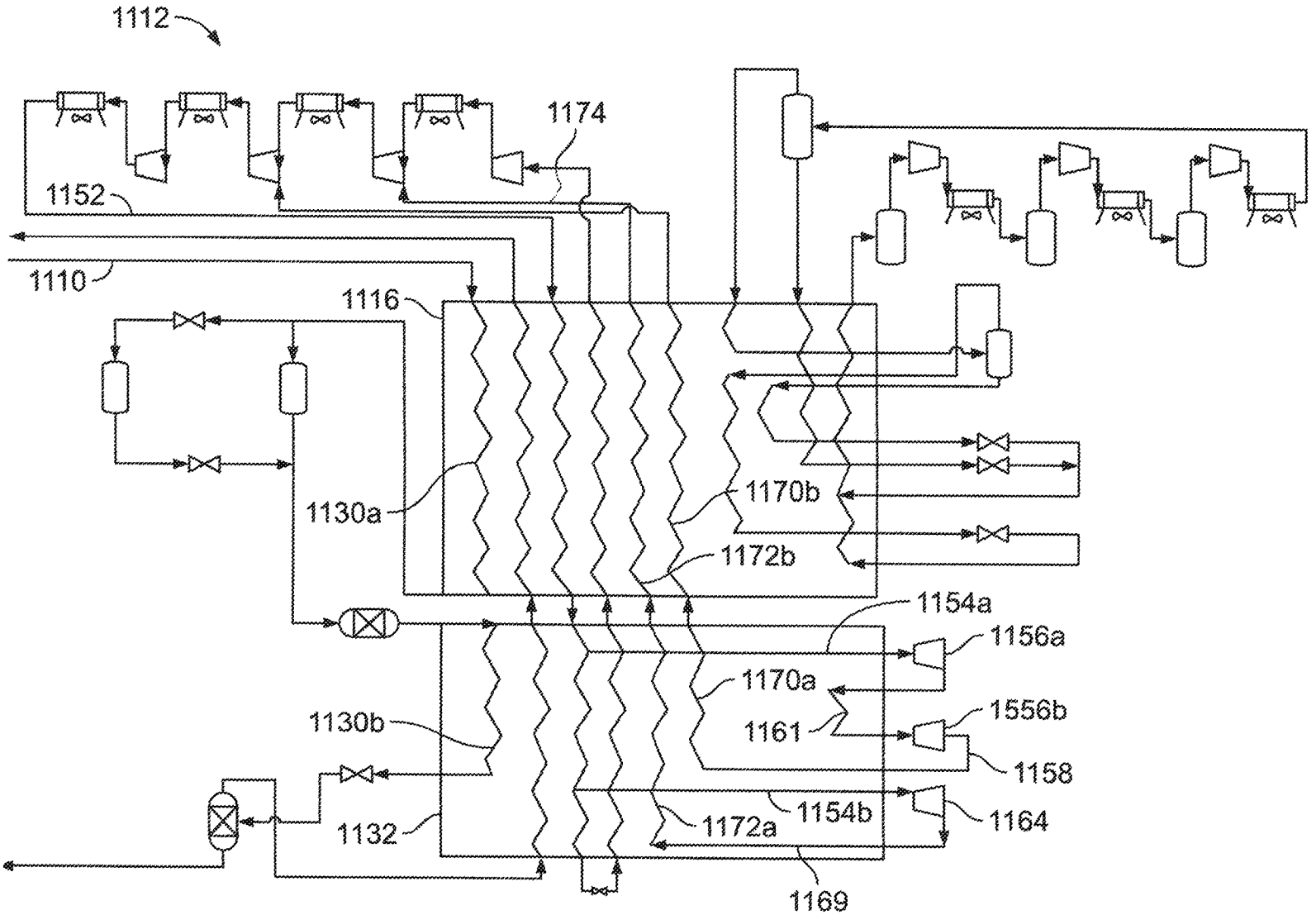
FIG. 11 is a process flow diagram and schematic illustrating a eleventh embodiment of the hydrogen liquefaction process and system of the disclosure.

A further alternative arrangement of the warm and cold expanders of the main cooling loop is presented in FIG. 11. In the system of FIG. 11, the main cooling loop 1112 provides a stream 1052 of hydrogen refrigerant gas (as examples only, helium or a mixture of neon and helium or a mixture of neon, helium and hydrogen or a mixture of helium and hydrogen may be used in alternative embodiments) to a warm heat exchanger 1116 and a cold heat exchanger 1132 where it is cooled. After entering the cold heat exchanger 1132, a first portion 1154*a* of the stream is split and directed to a first warm expander 1156*a*. The resulting expanded refrigerant stream is directed through intermediate cooling passage 1161 of cold heat exchanger 1132. The resulting cooled stream is directed to a second warm expander 1156*b*. The further cooled and expanded hydrogen stream 1158 is directed through first primary refrigeration passages 1170*a* and 1070*b* in cold and warm heat exchangers 1132 and 1116, respectively to cool and liquefy the hydrogen gas feed stream 1110 in cooling passages 1130*a* and 1130*b* via countercurrent heat exchange. A resulting vaporized refrigerant is provided to the compression system of the main cooling loop.

As further illustrated in FIG. 11, a second portion 1154*b* of the cooled hydrogen refrigerant stream splits and is directed through a cold expander 1164. The resulting expanded refrigerant stream 1169 is directed to second primary refrigeration passages 1172*a* and 1172*b* of cold and warm heat exchangers 1132 and 1116, respectively. A vaporized primary refrigerant stream 1174 is returned to the compression system of the main cooling loop.

The remainder of the system of FIG. 11 is the same as the systems of FIGS. 6 through 10.

While the preferred embodiments of the invention have been shown and described, it will be apparent to those skilled in the art that changes and modifications may be made therein without departing from the spirit of the invention.

What is claimed is:

1. A system for liquefying a hydrogen gas feed stream comprising:

a. a heat exchanger system having a feed gas inlet configured to receive the hydrogen gas feed stream, a product outlet, a cooling passage in fluid communication with the feed gas inlet and the product outlet, a primary refrigerant feed passage, a primary refrigeration passage, a pre-cooling refrigeration passage, a high pressure vapor cooling passage, a cold separator vapor cooling passage, a cold separator liquid cooling passage and a high pressure liquid cooling passage;

b. a primary refrigerant compression system configured to direct a conditioned primary refrigerant to the primary refrigerant feed passage;

c. a warm expander in fluid communication with the primary refrigerant feed passage, said warm expander having a warm expander outlet in fluid communication with the primary refrigerant compression system;

d. a cold expander in fluid communication with the primary refrigerant feed passage, said cold expander having a cold expander outlet in fluid communication with the primary refrigeration passage;

e. said cooling passage configured so that hydrogen therein is cooled and liquefied by countercurrent heat exchange with primary refrigerant in the primary refrigeration passage;

f. said primary refrigerant compression system configured to receive, compress and cool vaporized primary refrigerant from the primary refrigeration passage so that a conditioned primary refrigerant is provided;

g. a pre-cooling mixed refrigerant compression system including a pre-cooling compressor configured to receive and compress a pre-cooling mixed refrigerant stream and to direct a compressed mixed refrigerant stream to a pre-cooling aftercooler, said pre-cooling aftercooler having an aftercooler outlet in fluid communication with a high pressure separation device having a mixed refrigerant vapor outlet configured to direct mixed refrigerant vapor to the high pressure vapor cooling passage and a mixed refrigerant liquid outlet configured to direct mixed refrigerant liquid to the high pressure liquid cooling passage;

h. a cold vapor separator having an inlet configured to receive fluid from the high pressure vapor cooling passage, said cold vapor separator having a cold vapor separator vapor outlet configured to direct vapor to the cold separator vapor cooling passage and a cold vapor separator liquid outlet configured to direct liquid to the cold separator liquid cooling passage;

i. a first expansion device configured to receive and expand fluid from the cold separator vapor cooling passage and to direct expanded fluid to the pre-cooling refrigerant passage;

j. said high pressure liquid cooling passage and said cold separator liquid cooling passage each in fluid communication with the pre-cooling refrigeration passage;

k. said cooling passage configured so that hydrogen therein is cooled by countercurrent heat exchange with pre-cooling mixed refrigerant in the pre-cooling refrigeration passage.

2. The system of claim 1 wherein the heat exchanger system includes a warm heat exchanger and a cold heat exchanger.

3. The system of claim 2 wherein streams flowing through the warm heat exchanger are above approximately 80 K and streams flowing through the cold heat exchanger are below approximately 80 K.

4. The system of claim 2 wherein the pre-cooling refrigeration passage is formed solely in the warm heat exchanger and the primary refrigeration passage is formed in both the cold and warm heat exchangers.

5. The system of claim 1 wherein the primary refrigerant is selected from the group consisting of hydrogen, helium, a mixture of neon and helium, a mixture of neon, helium and hydrogen and a mixture of hydrogen and helium.

6. The system of claim 5 wherein the pre-cooling mixed refrigerant stream includes a component selected from the group consisting of nitrogen, methane, ethylene, ethane, propane, pentanes, isobutane and n-butane.

7. The system of claim 1 wherein the pre-cooling mixed refrigerant stream includes a component selected from the group consisting of nitrogen, methane, ethylene, ethane, propane, pentanes, isobutane and n-butane.

8. The system of claim 1 wherein the heat exchanger system includes a first primary refrigeration passage and the primary refrigeration passage is a second primary refrigeration passage and the warm expander is configured to receive a first portion of primary refrigerant from the primary refrigerant feed passage and to direct an expanded first portion of the primary refrigerant to the first primary refrigeration passage and the cold expander is configured to receive and expand a second portion of primary refrigerant that has been further cooled in the primary refrigerant feed passage and direct an expanded second portion of the primary refrigerant to the secondary primary refrigeration passage.

9. The system of claim 8 wherein the primary refrigerant compression system includes a first compressor configured to receive a vapor stream from the second primary refrigeration passage of the heat exchanger system, a first aftercooler configured to receive fluid from the first compressor, a second compressor configured to receive fluid from the first aftercooler and a second aftercooler configured to receive fluid from the second compressor, said second aftercooler in fluid communication with the primary refrigerant feed passage of the heat exchanger system and wherein the second compressor is configured to receive a vapor stream from the first primary refrigeration passage of the heat exchanger system.

10. The system of claim 8 wherein the primary compression system is configured to combined vaporized primary refrigerant streams from the first and second primary refrigeration passages prior to the first compression stage.

11. The system of claim 8 wherein the heat exchanger system includes a warm heat exchanger and a cold heat exchanger and wherein the first and second primary refrigeration passages pass solely through the cold heat exchanger, exit the cold heat exchanger and direct vapor to the primary refrigerant compression system and wherein the pre-cooling refrigeration passage passes solely through the warm heat exchanger.

12. The system of claim 8 wherein the warm expander and the cold expander are turbines that power conditioning compressors that are configured to receive and compress a primary refrigerant vapor stream from the second primary refrigeration passage and to direct compressed vapor to the primary refrigerant compression system.

13. The system of claim 1 further comprising catalyst in the cooling passage of the heat exchanger system so that conversion of hydrogen from ortho to para states is accomplished as hydrogen is cooled and/or liquefied in the cooling passage.

14. The system of claim 1 further comprising a series of warm expanders, including the warm expander, in fluid communication with the primary refrigerant feed passage, said series of warm expanders in fluid communication with the primary refrigerant compression system and a series of cold expanders, including the cold expander, in fluid communication with the primary refrigerant feed passage, said series of cold expanders in fluid communication with the primary refrigeration passage.

15. The system of claim 14 wherein the warm series of expanders and the cold series of expanders include turbines.

16. The system of claim 1 further comprising:

l. a second expansion device configured to receive and expand fluid from said high pressure liquid cooling passage, said second expansion device in fluid communication with the pre-cooling refrigeration passage;

m. a third expansion device configured to receive and expand fluid from said cold separator liquid cooling passage, said third expansion device in fluid communication with the pre-cooling refrigeration passage.

17. The system of claim 1 wherein the warm expander is configured to receive a first portion of primary refrigerant from the primary refrigerant feed passage and the warm expander and the cold expander are turbines that power compressors and further comprising:

l. an intermediate cooling passage within the heat exchanger system configured to receive and cool fluid from the warm expander and to direct fluid to the cold expander, wherein said cold expander outlet is configured to direct an expanded first portion of primary refrigerant to the primary refrigeration passage;

m. a primary feed expansion device configured to receive and expand a second portion of primary refrigerant that has been further cooled in the primary refrigerant feed passage and direct an expanded second portion of the primary refrigerant to the heat exchanger system.

18. The system of claim 17 further comprising:

n. a supplemental cold expansion device configured to direct fluid to the primary refrigeration passage;

o. a supplemental intermediate cooling passage within the heat exchanger system configured to receive and cool fluid from the cold expander and to direct fluid to the supplemental cold expansion device.

19. The system of claim 1 wherein the warm expander is a first warm expander configured to receive a first portion of primary refrigerant from the primary refrigerant feed passage and further comprising:

l. a second warm expander configured to receive a first portion of fluid from the first warm expander and to direct fluid to the primary refrigeration passage;

m. an intermediate cooling passage within the heat exchanger system configured to receive and cool a second portion of fluid from the first warm expander and to direct fluid to the cold expander;

n. a primary feed expansion device configured to receive and expand a second portion of primary refrigerant that has been further cooled in the primary refrigerant feed passage and direct an expanded second portion of the primary refrigerant to the heat exchanger system.

20. The system of claim 1 wherein the heat exchanger system includes a first primary refrigeration passage and the primary refrigeration passage is a second primary refrigeration passage, the warm expander is configured to receive a first portion of primary refrigerant from the primary refrigerant feed passage and direct fluid to the first primary refrigeration passage and the cold expander is a first cold expander configured to receive a second portion of primary refrigerant from the primary refrigerant feed passage and further comprising:

l. a second cold expander configured to direct fluid to the second primary refrigeration passage;

m. an intermediate cooling passage within the heat exchanger system configured to receive and cool fluid from the first cold expander and to direct fluid to the second cold expander;

n. a primary feed expansion device configured to receive and expand a third portion of primary refrigerant that has been further cooled in the primary refrigerant feed passage and direct an expanded third portion of the primary refrigerant to the heat exchanger system.

21. The system of claim 1 wherein the heat exchanger system includes a first primary refrigeration passage and the primary refrigeration passage is a second primary refrigeration passage and the warm expander is configured to receive a first portion of primary refrigerant from the primary refrigerant feed passage and further comprising:

l. an intermediate expander configured to receive a second portion of primary refrigerant from the primary refrigerant feed passage and to direct an expanded second portion of primary refrigerant to the first primary refrigeration passage;

m. an intermediate cooling passage within the heat exchanger system configured to receive and cool fluid from the warm expander and to direct fluid to the cold expander, wherein said cold expander outlet is configured to direct an expanded first portion of primary refrigerant to the second primary refrigeration passage;

n. a primary feed expansion device configured to receive and expand a third portion of primary refrigerant that has been further cooled in the primary refrigerant feed passage and direct an expanded third portion of the primary refrigerant to the heat exchanger system.

22. The system of claim 1 wherein the heat exchanger system includes a first primary refrigeration passage and the primary refrigeration passage is a second primary refrigeration passage, the warm expander is a first warm expander configured to receive a first portion of primary refrigerant from the primary refrigerant feed passage and the cold expander is configured to receive a second portion of primary refrigerant from the primary refrigerant feed passage and direct an expanded second portion of primary refrigerant to the first primary refrigeration passage and further comprising:

l. a second warm expander configured to direct fluid to the first primary refrigeration passage;

m. an intermediate cooling passage within the heat exchanger system configured to receive and cool fluid from the first warm expander and to direct fluid to the second warm expander;

n. a primary feed expansion device configured to receive and expand a third portion of primary refrigerant that has been further cooled in the primary refrigerant feed passage and direct an expanded third portion of the primary refrigerant to the heat exchanger system.

23. The system of claim 1 wherein the heat exchanger system includes a warm heat exchanger and a cold heat exchanger and wherein the heat exchanger system includes a first primary refrigeration passage solely in the cold heat exchanger and the primary refrigeration passage is a second primary refrigeration passage solely in the cold heat exchanger and the warm expander is configured to receive a first portion of primary refrigerant from the primary refrigerant feed passage and to direct an expanded first portion of the primary refrigerant to the first primary refrigeration passage and the cold expander is configured to receive and expand a second portion of primary refrigerant that has been further cooled in the primary refrigerant feed passage and direct an expanded second portion of the primary refrigerant to the secondary primary refrigeration passage and wherein said primary refrigerant compression system is configured to receive, cold compress and cool vaporized primary refrigerant from the first and second primary refrigeration passages so that a conditioned primary refrigerant is provided.

24. A method for liquefying a hydrogen gas feed stream comprising the steps of:

a. pre-cooling the hydrogen gas feed stream using a mixed refrigerant by:

i) compressing and cooling a mixed refrigerant stream to form a high pressure mixed refrigerant stream;

ii) separating the high pressure mixed refrigerant stream to form a high pressure mixed refrigerant vapor stream and a high pressure mixed refrigerant liquid stream;

iii) cooling the high pressure mixed refrigerant vapor stream in a heat exchanger, to form a mixed phase stream;

iv) separating the mixed phase stream with a cold vapor separator, to form a cold separator vapor stream and a cold separator liquid stream;

v) condensing the cold separator vapor stream and flashing, to form a cold temperature refrigerant stream;

vi) cooling the high pressure mixed refrigerant liquid stream in the heat exchanger, to form a cooled high pressure mixed refrigerant liquid stream;

vii) cooling the cold separator liquid stream to form a cooled cold separator liquid stream and combining the cooled cold separator liquid stream with the cooled high pressure mixed refrigerant liquid stream, to form a middle temperature refrigerant stream;

viii) combining the middle temperature refrigerant stream and the cold temperature refrigerant stream to form a combined pre-cool refrigerant stream;

ix) thermally contacting the hydrogen gas feed stream with the combined pre-cool refrigerant stream in the heat exchanger to form a pre-cooled hydrogen gas feed stream;

b. liquefying the pre-cooled hydrogen gas feed stream using a primary refrigerant by:

i) compressing and cooling a first vaporized primary refrigerant and a second vaporized primary refrigerant to form a high pressure primary refrigerant;

ii) expanding the high pressure primary refrigerant in a warm expander to form a first expanded primary refrigerant;

iii) expanding the high pressure primary refrigerant in a cold expander to form a second expanded primary refrigerant;

iv) thermally contacting the pre-cooled hydrogen gas feed stream with the first and second expanded refrigerants to form first and second vaporized primary refrigerants and a liquefied hydrogen stream.

25. The method of claim 24 wherein the primary refrigerant is selected from the group consisting of hydrogen, helium and a mixture of hydrogen and helium.

* * * * *